US005683227A

United States Patent [19]

Nagai et al.

[11] Patent Number: 5,683,227

[45] Date of Patent: Nov. 4, 1997

[54] MULTISTAGE EJECTOR ASSEMBLY

[75] Inventors: Shigekazu Nagai; Hiroshi Matsushima, both of Yawara-mura, Japan

[73] Assignee: SMC Corporation, Tokyo, Japan

[21] Appl. No.: 338,517

[22] PCT Filed: Feb. 4, 1994

[86] PCT No.: PCT/JP94/00294

§ 371 Date: Nov. 28, 1994

§ 102(e) Date: Nov. 28, 1994

[87] PCT Pub. No.: WO94/23212

PCT Pub. Date: Oct. 13, 1994

[30] Foreign Application Priority Data

Mar. 31, 1993 [JP] Japan ..... 5-096625
Aug. 9, 1993 [JP] Japan ..... 5-216957

[51] Int. Cl.[6] ..... F04F 5/20

[52] U.S. Cl. ..... 417/174; 417/187

[58] Field of Search ..... 417/174, 187, 417/186, 188, 190

[56] References Cited

U.S. PATENT DOCUMENTS

| | | | |
|---|---|---|---|
| 1,491,057 | 4/1924 | Myers | 417/174 |
| 2,812,723 | 11/1957 | Coberly | 417/174 |
| 3,959,864 | 6/1976 | Tell | 417/174 |
| 4,432,701 | 2/1984 | Ise | 417/187 |
| 4,466,778 | 8/1984 | Voklmann | 417/174 |
| 4,655,692 | 4/1987 | Ise | 417/187 |
| 4,865,521 | 9/1989 | Ise | 417/187 |
| 4,880,358 | 11/1989 | Lasto | 417/174 |
| 4,950,016 | 8/1990 | Kumar | 417/187 |
| 5,228,839 | 7/1993 | Peterson et al. | 417/174 |

FOREIGN PATENT DOCUMENTS

| | | | |
|---|---|---|---|
| 41055 | 12/1981 | European Pat. Off. | 417/174 |
| 527386 | 11/1920 | France | 417/174 |
| 3522111 | 1/1986 | Germany | 417/187 |
| 4011218 | 10/1991 | Germany | 417/174 |
| 98200 | 6/1985 | Japan | 417/187 |
| 61-9999 | 3/1986 | Japan | 417/174 |

*Primary Examiner*—Timothy Thorpe
*Assistant Examiner*—Ted Kim
*Attorney, Agent, or Firm*—Oblon, Spivak, McClelland, Maier & Neustadt, P.C.

[57] ABSTRACT

A multistage ejector assembly which can be assembled in an extremely facilitated manner, at a low cost, and while avoiding from high precision assembling work for a plural number of nozzles and diffusers. The multistage ejector assmbly includes a casing body (2) of a channel-like shape in cross-section having an axial through hole (5) internally of a thick bottom wall for receiving a nozzle body (12) and a multistage ejector structure (14) therein. The multistage ejector structure (14) includes of an integral molded structure including diffuser-nozzles (15*a*) and (15*b*) and a diffuser (15*c*) of a final stage located in an axially aligned state relative to a spout hole (13) of the nozzle body and interconnected through larger diameter portions (16*a*) and (16*b*) with air sucking openings (16*a*) and (16*b*), and flanges 18*a* to (18*c*) formed around the circumference of the ejector structure. The nozzle body and the multistage ejector structure are hermetically fitted in the axial through hole in the casing body by the flanges a number of vacuum generating chambers (21*a*) to (21*c*) within the through hole in communcation with a suction port (31) through a number of suction passages provided on the casing body.

3 Claims, 6 Drawing Sheets

MULTISTAGE EJECTOR ASSEMBLY

BACKGROUND OF THE INVENTION

1. Field of the Art

This invention relates to a multistage ejector assembly which is provided with a plural number of nozzles in series for the purpose of increasing the intake air quantity or the suction force of the ejector.

2. Description of the Prior Art

Multistage ejector assemblies incorporating a plural number of nozzles in multiple stages for augmentation of the amount of intake air or suction force have been known in the art, for example, from Japanese Patent Publication No. 59-24280 (U.S. Pat. No. 3,959,864) and Japanese Patent Publication No. 63-29120 (U.S. Pat. No. 4,466,778). The multistage ejector of this sort has an inherent problem in that a slight degree of misalignment of the axes of the nozzles which are arranged in series could result in considerable degradations in its suctional performance quality. For instance, the desired performance quality cannot be expected unless the concentricity of the respective nozzles is less than a few hundredths of one millimeter.

In this regard, according to the prior art multistage ejector assemblies proposed in the above-mentioned patent publications, a plural number of separately shaped nozzles are assembled into an ejector casing in series in the axial direction of the casing. It follows that high precision work is required not only in the machining operations on the ejector casing but also in the nozzle assembling operations, making these machining and assembling operations troublesome and resulting in a high production cost.

With a view to providing a multistage ejector assembly at low cost, attempts have thus far been made to form the whole ejector into one integral structure by plastic molding, as disclosed in Japanese Laid-Open Patent Application H2-37200 (U.S. Pat. No. 4,960,364). However, in this case it is extremely difficult to enhance the accuracy of molding to such a degree as to completely eliminate partial irregularities in thickness which normally exist in plastic moldings, and to maintain the original accuracy of molded structural shapes over an extended period of time.

SUMMARY OF THE INVENTION

It is a primary object of the present invention to provide a multistage ejector assembly which can be assembled very easily without involving a high precision work in assembling a plural number of nozzles of the multistage ejector and which can be fabricated at a low cost.

It is another object of the present invention to provide a multistage ejector assembly which has a number of its major high precision components such as nozzles and diffusers of the multistage ejector formed into an integral structure by molding to preclude the necessity for aligning the center axes of the respective nozzles and diffusers in the ejector assembling stage, facilitating the operation of assembling a multistage ejector into a casing body and its replacement.

It is still another object of the present invention to provide a multistage ejector assembly employing an integral multistage ejector structure which can be easily fitted into a bore on a casing body or which can be fixed on a flat ejector mounting surface on a casing body by the use of extremely simple means, thereby permitting to simplify machining operations on the casing body.

It is a further object of the present invention to provide a multistage ejector assembly which is arranged in such a way that a vacuum generating chamber is defined within a casing body upon assembling a multistage ejector structure into the casing body, thereby simplifying the construction of the casing body as well as the construction of the multistage ejector structure to be assembled into the casing body.

It is a further object of the present invention to provide a multistage ejector assembly which is arranged in such a way that a check valve or check valves to be incorporated into the multistage ejector for blocking air flows into a suction passage or passages can be mounted in position upon assembling a multistage ejector structure into a casing body, thereby facilitating the check valve assembling procedure.

It is a further object of the invention to provide a multistage ejector assembly employing a casing body of a channel-like shape in cross-section, the casing body having a multistage ejector mounting surface on a thick bottom wall, and a pair of side walls formed integrally with the bottom wall to define a channel-like groove therebetween, the side walls contributing to enhance the strength of the casing body against bending force while providing protection for a multistage ejector structure on the ejector mounting surface and maintaining over an extended time period the original shapes of the multistage ejector structure which is formed with an intended accuracy in terms of concentricity of its nozzles and diffusers.

It is another object of the present invention to provide a multistage ejector assembly utilizing the above-mentioned channel-like groove as a vacuum chamber for accommodation of a suction filter, eliminating wastful spaces in construction of the multistage ejector assembly.

In accordance with the present invention, the above-mentioned objectives are achieved by the provision of a multistage ejector assembly of the type including a casing body and a multistage ejector assembled into the casing body to produce a suction force of vacuum pressure at a suction port by the action of pressurized air supplied to the multistage ejector, characterized in that the multistage ejector assembly comprises: an axial through hole formed in the casing body for receiving a multistage ejector therein; and the multistage ejector constituted by a nozzle body connected to a supply of pressurized air and having a spout hole for jetting pressurized air therefrom, and a multistage ejector structure, which multistage ejector structure includes a number of diffuser-nozzles including a diffuser of a final stage each located in axially aligned relation with the spout hole of the nozzle body and interconnected through a larger diameter portion with a suction opening, and flanges formed around the diffuser-nozzles and the diffuser of the final stage; the nozzle body and multistage ejector structure being hermetically fitted in the axial through hole on the casing body to define therein a number of vacuum generating chambers by the flanges, the vacuum generating chambers being communicated with the suction port through a number of suction passages provided on the casing body.

In a preferred form of the above-described multistage ejector assembly according to the present invention, the casing body is formed in a channel-like shape in section having a thick bottom wall internally providing an axial through hole to receive the multistage ejector structure, and a channel-like groove extending along the bottom wall, and the multistage ejector assembly further comprises a vacuum chamber provided within the channel-like groove of the casing body between the suction port and the suction passages from the respective vacuum generating chambers, and check valves anchored between the inner periphery of the axial through hole of the casing body and the flanges of the multistage ejector structure to block air flows to the suction passages from the respective vacuum generating chambers.

In another preferred form of the multistage ejector assembly according to the present invention, the casing body is provided with a flat plate-like surface for mounting a multistage ejector thereon, and the multistage ejector is constituted by a nozzle body with a spout hole for jetting out supplied compressed air, and a multistage ejector structure, which multistage ejector structure including a frame body open on the upper and lower sides thereof, partition walls dividing the frame body into a number of sections, and a number of diffuser-nozzles including a diffuser of a final stage retained on the partition walls in axially aligned relation with the spout hole of the nozzle body, the multistage ejector structure being hermetically gripped between the flat ejector mounting surface on the casing body and a diffuser conver to define therein a number of vacuum generating chambers by the frame body and the partition walls in communication with the suction port through a number of suction passages provided on the casing body.

In this multistage ejector assembly, the casing body is provided with a thick bottom wall with a flat plate-like surface on the outer or lower side thereof for mounting the multistage ejector thereon, and with a channel-like groove formed along and on the upper side of the bottom wall, the multistage ejector assembly further comprising a vacuum chamber provided within the channel-like groove of the casing body in communication with the suction port on one side thereof and with the vacuum generating chambers on the other side through the respective suction passages.

Further, in this case, the multistage ejector assembly may further include an air supply valve for supplying compressed air to the nozzle body, and a vacuum breaker valve for supplying compressed air to the vacuum chamber.

The multistage ejector assembly of the above-described arrangements contributes to a reduction in production cost by facilitating the assembling work, which can be completed simply by inserting the multistage ejector structure into the through hole provided on the casing body or by mounting the multistage ejector structure on the flat surface on the outer side of the bottom wall of the casing body in contrast to the conventional multistage ejectors which require high precision assembling of a plural number of nozzles.

Besides, the multistage ejector including the high precision parts like nozzles and diffusers is provided as one integral molded structure which obviates the time-consuming centering jobs for a plural number of nozzles and diffusers, while facilitating the job of assembling the multistage ejector structure info the casing body as well as its replacement and the machining operation for the casing body.

BEST MODE FOR CARRYING OUT THE INVENTION

Figure 1:
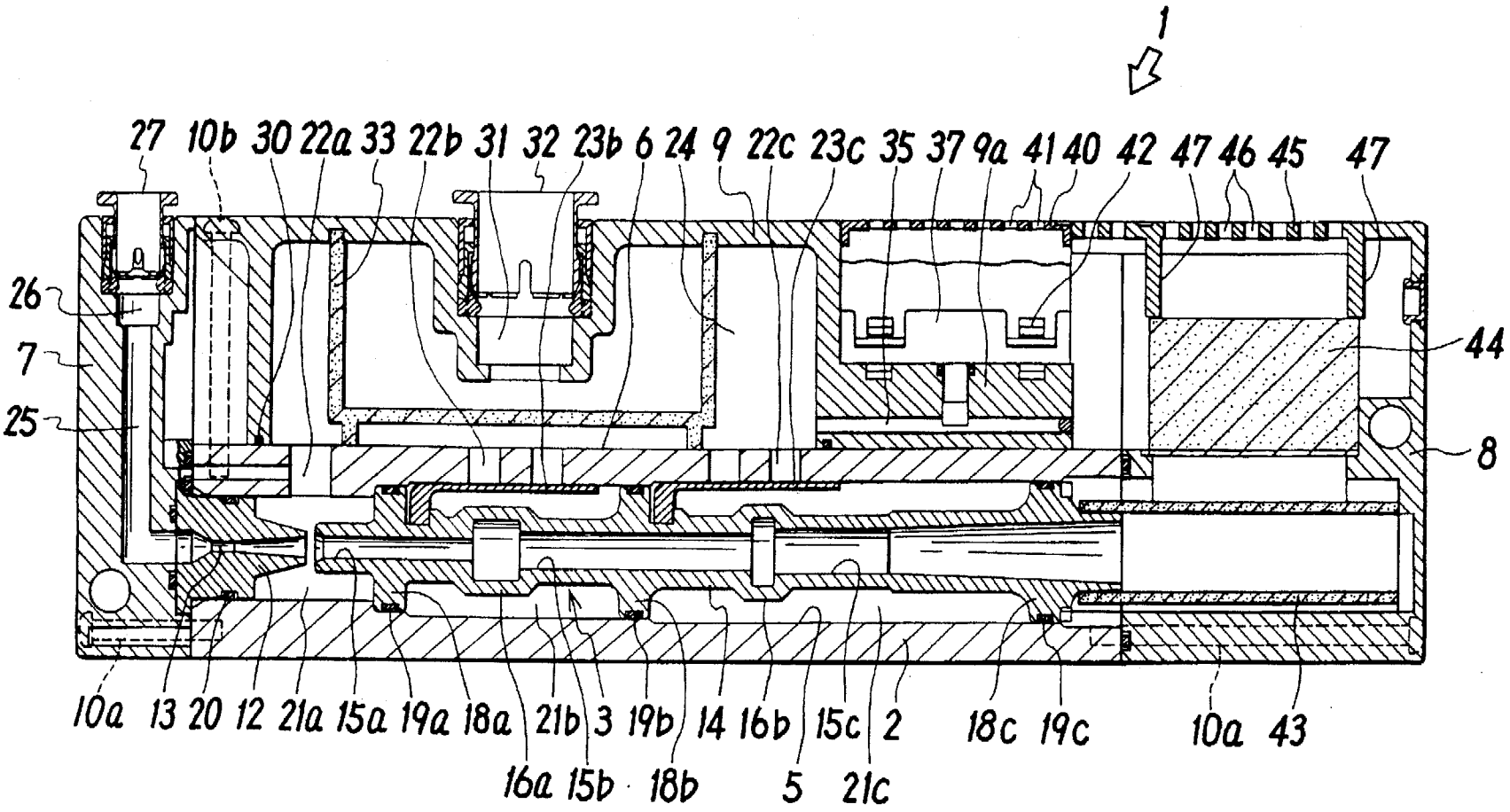
FIG. 1 is a longitudinally sectioned front view of a first embodiment of the present invention.
Figure 2:
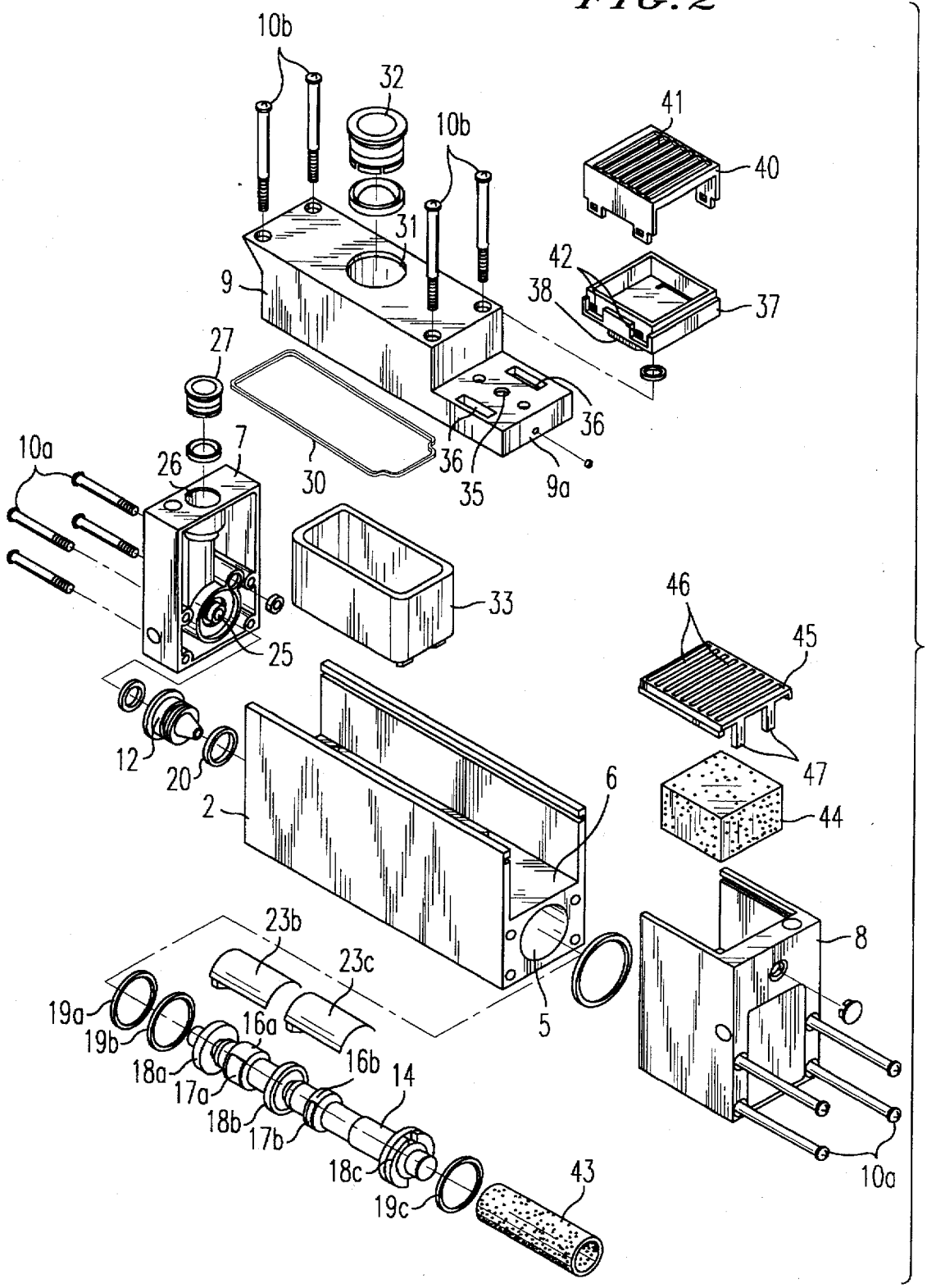
FIG. 2 is an exploded perspective view of the same embodiment.

Referring to FIGS. 1 and 2 which illustrate the first embodiment of the multistage ejector assembly according to the present invention, the multistage assembly which is indicated at 1 is largely constituted by a casing body 2 and a multistage ejector 3.

The casing body 2 is channel-shaped with a thick bottom wall which internally contains an axial through hole 5 to receive the multistage ejector 3 and a channel-like groove 6 provided coextensively on the upper side of the bottom wall. The casing body 2 consists of an integral structure of a metal extrudate or of plastic injection molding. Front and end covers 7 and 8 are securely fixed to the opposite ends of the casing body 2 by a plural number of screws 10*a*, while a suction cover 9 is securely fixed to the open side of the channel-like groove 6 similarly by a plural number of screws 10*b*.

The multistage ejector 3 is constituted by a nozzle body 12 with a spout hole 13 for spurting an operating fluid therefrom, and a multistage ejector structure 14 which is positioned in the fluid spouting direction of the spout hole 13 in the nozzle body 12. The multistage ejector structure 14 is formed generally into a tubular shape body made from a metallic or synthetic resin material, and provided with diffuser-nozzles 15*a* and 15*b* and a diffuser 15*c* of a final stage successively along its center axis, the diffuser-nozzles 15*a* and 15*b* and the final stage diffuser 15*c* being intervened by enlarged diameter portions 16*a* and 16*b* with air suction openings 17*a* and 17*b* (FIG. 2). The above-mentioned diffuser-nozzles 15*a* and 15*b* and the final stage diffuser 15*c* are gradually increased in diameter in that order, and additionally the final stage diffuser 15*c* is diverged in a tapered fashion from its middle point.

Flanges 18*a* to 18*c* are formed on the circumferential surfaces of the diffuser-nozzles 15*a* and 15*b* and the final stage diffuser 15*c* on the above-described multistage ejector structure 14, respectively. The multistage ejector structure 14 is hermetically fitted into the axial through hole 5 by the use of resilient seal rings 19*a* to 19*c* which are interposed between the flanges 18*a* to 19*c* and inner peripheral surfaces of the axial hole 5, respectively. On the other hand, the nozzle body 12 is hermetically fitted into the axial hole 5 from the opposite direction through a seal ring 20, in such a manner that the spout hole 13 of the nozzle body 12 is axially aligned with the diffuser-nozzles 15*a* and 15*b* and the final stage diffuser 15*c*. By so doing, a first vacuum generating chamber 21*a* of an anterior stage is defined within the axial through hole 5 by and between the hermetically fitted nozzle body 21 and the flange 18*a* on the multistage ejector structure 14, and second and third vacuum generating chambers 21*b* and 21*c* of posterior stages are defined within the axial hole 5 between the flanges 18*a* and 18*b* and between the flanges 18*b* and 18*c* of the multistage ejector structure 14, respectively. The air suction openings 17*a* and 17*b* in the enlarged diameter portions 16*a* and 16*b* are opened into the vacuum generating chambers 21*b* and 21*c* of the posterior stages, respectively.

Provided at the bottom of the channel-like groove 6 of the casing body 2 are suction passages 22*a* to 22*c* which are located corresponding to the afore-mentioned vacuum generating chambers 21*a* to 21*c*, which vacuum generating chambers 21*a* to 21*c* being communicated with a vacuum chamber 24 which is hermetically closed with the suction cover 9 within the channel-like groove 6 on the casing body 2. Grooves are formed on one side of the flanges 18*a* and 18*b* of the multistage ejector structure 14 for fitting semi-cylindrical check valves **23*b* and 23*c* which are adapted to close the suction passages 22*b* and 22*c* by hermetical contact with the cylindrical inner surface of the through hole 5, respectively. More specifically, bulged and bent base portions of the check valves 23*b* and 23*c* are anchored in the grooves in such a way as to hold them against the inner surface of the through hole 5. These check valves 23*b* and 23*c* function to block air flows into the suction passages 22*b* and 22*c* from the respective vacuum generating chambers 21*b* and 21*c*** of the posterior stage.

The front cover 7 is provided with a compressed air supply passage 25 the fore end of which is communicated with the spout hole 13 in the nozzle body 12. A tube from a compressed air source is connected to a compressed air supply port 26 at the base or outer end of the air supply passage 25 through a push-on type pipe joint 27.

Therefore, by the action of compressed air which is supplied to the air supply passage 25 through the inlet port 26 and spurted toward the diffuser-nozzle **15*a* of the multistage ejector structure 14 from the nozzle hole 13 of the nozzle body 12, air in the first vacuum generating chamber 21*a* is sucked out to develop a vacuum pressure there. Further, by the action of the air pressure which is spurted successively from the diffuser-nozzles 15*a* and 15*b*, air in the vacuum generating chambers 21*b* and 21*c* of the posterior stages is sucked through the air suction openings 17*a* and 17*b* to develop a vacuum pressure also in these chambers. As a consequence, through the suction passages 22*a*, 22*b* and 22*c*, a vacuum pressure is developed in the vacuum chamber 24 which is hermeticaly closed by the suction cover 9 within the channel-like groove 6 of the casing body 2. In this instance, the check valves 23*b* and 23*c* which are anchored in position on the multistage ejector structure 14 operate to open or close the suction passages 22*b* and 22*c* according to the pressure differential between the vacuum pressure prevailing in the vacuum chamber 24 and the vacuum pressure prevailing in the vacuum generating chambers 21*b* and 21*c***.

The suction cover 9 is hermetically fixed to the inner bottom surface of the casing body 2 by screws **10*b* to define the above-mentioned vacuum chamber 24 therein, through a gasket 30 which hermetically seals the front end faces of its peripheral walls. Opened substantially at the center of the top wall of the suction cover 9 is a suction port 31 which is provided with a push-on type pipe joint 32 for connection thereto of a vacuum pressure supply tube. Further, a box-like suction filter 33 is mounted around the suction port 31 within the vacuum chamber 24 of the suction cover 9**.

On the side of the end cover 8, the suction cover 9 is integrally formed with a lower deck portion 9a for mounting a vacuum switch thereon. Opened on the upper side of the lower deck portion **9*a* is the fore end of a passage 35 which is in communication with the vacuum chamber 24 within the suction cover 9. The fore end of a horizontal bore of the passage 35, which is bored through the lower deck portion 9*a*, is closed with a ball. The lower deck portion 9*a*, on which a vacuum switch is mounted as will be described hereinlater in relation with a second embodiment of the invention, is provided with mounting slots 36 on the upper side, as shown particularly in FIG. 2, for engagement with projections 38 on a square box-like vacuum block base 37 to be mounted on the deck lower portion 9*a* to close the upper open end of the passage 35 in case a vacuum switch is not mounted on the deck 9*a*. A silencer cover 40 with a multitude of exhaust holes 41 is mounted on top of the vacuum block base 37 through engagement with stopper projections 42. The exhaust holes 41 in the silencer cover 40 function as a release passage for exhaust air which is discharged toward the end cover 8 from the diffuser 15*c*** of the final stage.

On the other hand, the end cover 8 is open on the side of the casing body 2 and on its upper side, and accommodates therein a first silencer 43 of a hollow cylindrical shape which is fitted on the fore end of the mutistage ejector structure 14, along with a block-like second silencer 44 which is located on intermediate stepped portions. A silencer cover 45 with a multitude of exhaust holes 46 and a holder portion 47 for the second silencer 44 is mounted in the upper opening on the upper side of the end cover 8. Needless to say, the silencers 43 and 44 are formed of porous material with sound absorbing properties.

Figure 3:
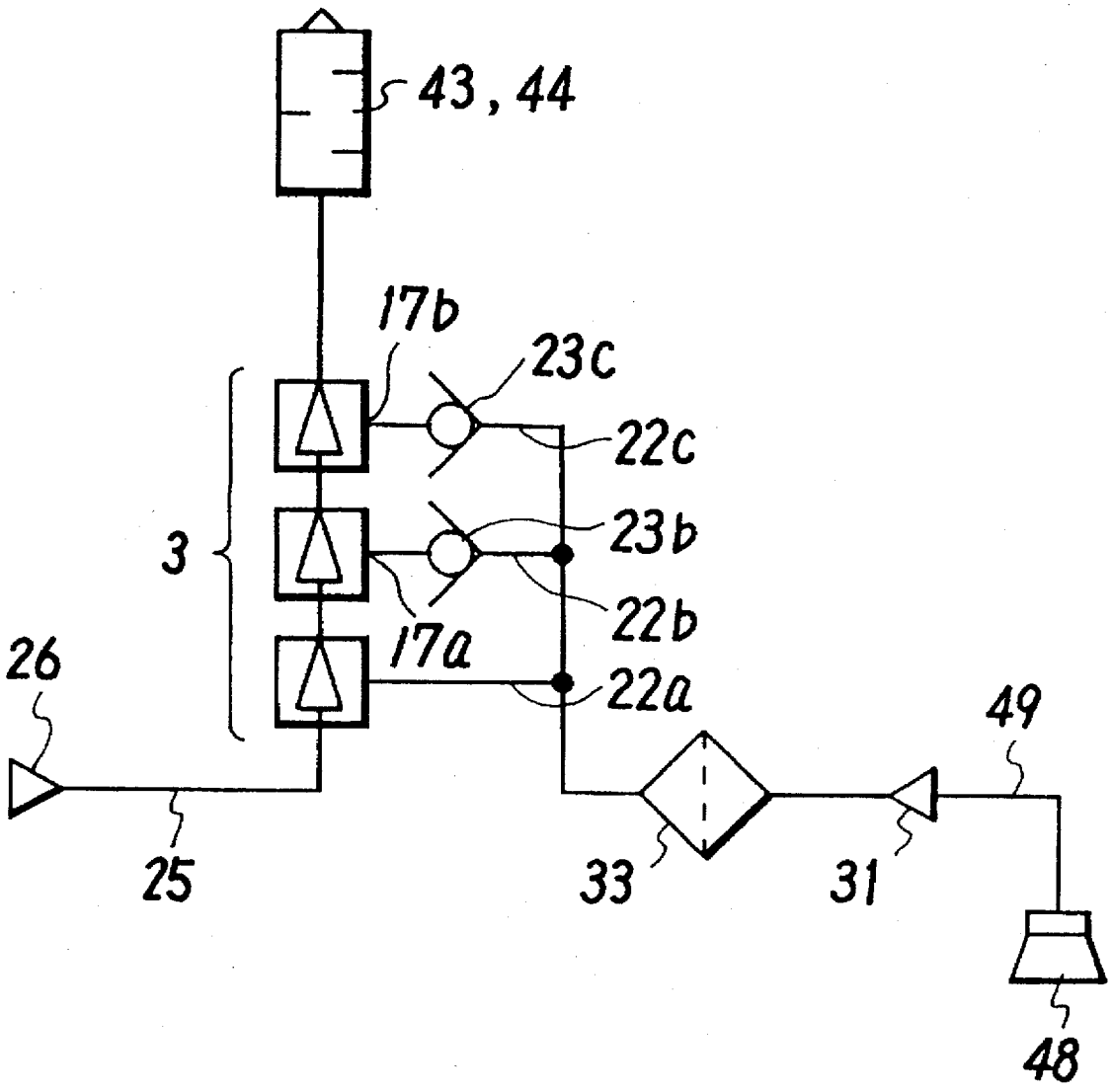
FIG. 3 schematically shows the layout of major components in the first embodiment by means of symbolic marks.

FIG. 3 illustrates the mode of operation by the above-described multistage ejector assembly by way of symbolic marks. In this particular case, a tube 49 with a suction pad 48 is connected to the suction port 31. Other component parts shown in FIG. 3 are designated by the same reference numerals or characters as their counterparts in FIGS. 1 and 2.

With the multistage ejector assembly of the above-described construction, as soon as compressed air is fed to the nozzle body 12 from the air supply port 26 through the supply passage 25, air in the first vacuum generating chamber 21 is sucked out to develop vacuum pressure therein as described hereinbefore, and vacuum pressure is further developed in the vacuum generating chambers **21*b* and 21*c* of the posterior stages by the air pressure which is successively spurted from the diffuser-nozzles 15*a* and 15*b*, letting the vacuum pressure prevail in the vacuum chamber 24 through the suction passage 22*a* or through suction passages 22*b* and 22*c* via check valves 23*b* and 23*c* which are opened and closed by pressure differentials. Therefore, as soon as the suction pad 48 is connected to the suction port 31 through the tube 49 as shown in FIG. 3, it is imparted with a suction force under the influence of the vacuum pressure through the suction filter 33. Exhaust air from the diffuser 15 in the final stage of the multistage ejector structure 14 is calmed down through the silencers 43 and 44** before release to the outside.

With the above multistage ejector assembly, the multistage ejector structure itself is constituted by the diffuser-nozzles **15*a* and 15*b* and the final stage diffuser 15*c*, which are interconnected through the larger diameter portions 16*a* and 16*b* with the air suction openings 17*a* and 17*b* and formed into an integral tubular body from a synthetic resin material along with the flanges 18*a* to 18*c*. Therefore, the diffuser-nozzles 15*a* and 15*b* and the final stage diffuser 15*c***, which normally require high precision work to comply with a required degreee of concentricity, can be fabricated at a significantly reduced cost.

Besides, as mentioned hereinbefore, the casing body 2 which accommodates the cylindrical molded body of the multistage ejector structure is formed in a channel-like shape in section with a bottom wall of large thickness and a couple of side walls on the opposite sides of the groove 6 to implement its strength against bending forces, receiving the multistage ejector structure 14 in the through hole 5 internally of the thick bottom wall. In this case, the multistage ejector structure 14 is protected by the casing body 2 of enhanced strength, so that the accuracy of the multistage ejector structure 14 including accuracy in concentricity can be maintained over a long period of time free of troubles as caused by deformation of the ejector structure 14 itself. In addition, the suction filter 33 which is located within the groove 6 of the casing body 2 is utilized as the suction chamber 24 to eliminate wasteful portions in construction.

Moreover, upon inserting the nozzle body 12 into the through hole 5 of the casing body 2 from one end thereof while inserting the multistage ejector structure 14 with the check valves **23*b* and 23*c* from the other end of the through hole 5, the vacuum generating chamber 21*a* of the anterior stage and the vacuum generating chambers 21*b* and 21*c* of the posterior stages are defined within the through hole 5 by the nozzle body 12 and the flanges 18*a* to 18*c* on the circumference of the ejector structure 14, and the check valves 23*b* and 23*c* are anchored in position to close the suction passages 22*b* and 22*c*. Therefore, the multistage ejector 3 including the vacuum generating chambers and check valves can be assembled in an extremely simplified manner, in addition to facilitated maintenance and easy replacement of the multistage ejector structure 14** in case of a damage thereto.

For the purpose of maintaining the vacuum pressure in the course of a suction transfer of a work which is held on the suction pad 48, a check valve which blocks air flows from the vacuum generating chamber **21*a* to the vacuum chamber 24 may be additionally provided on the multistage ejector structure 14 in the same fashion as the above-described check valves 23*b* and 23*c*** if necessary.

Figure 4:
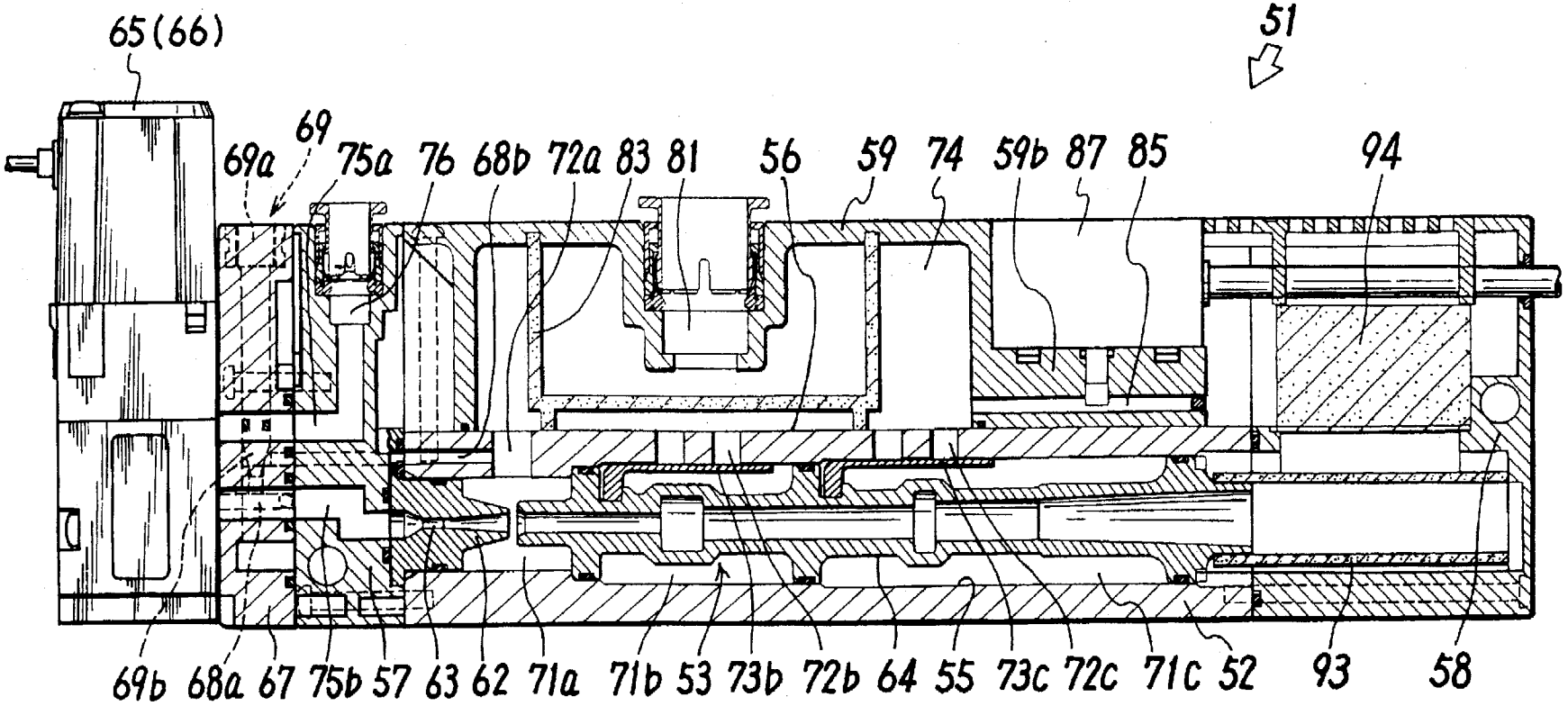
FIG. 4 is a longitudinally sectioned front view of a second embodiment of the invention.
Figure 5:
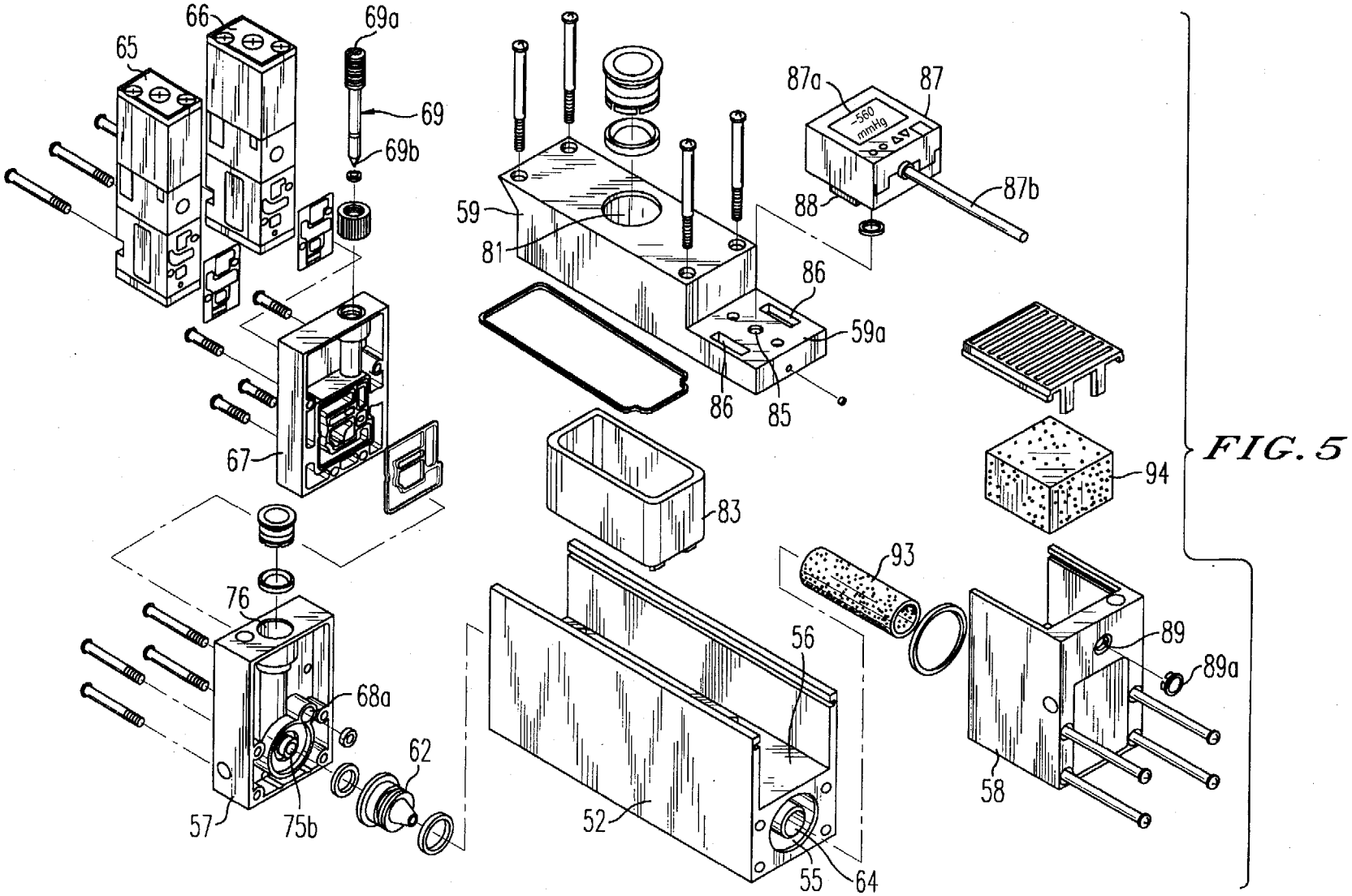
FIG. 5 is an exploded perspective view of the second embodiment.

Illustrated in FIGS. 4 and 5 is a second embodiment of the multistage ejector assembly according to the present invention. This multistage ejector assembly 51 is arranged in the same manner as the above-described first embodiment in constructions of casing body 52, multistage ejector 53, end cover 58 and suction cover 59. Of course, the casing body 52 is provided with a through hole 55 in its bottom wall along a channel-like groove 56 in the same manner as in the first embodiment, and the ejector 53 is provided with a nozzle body 62 with a spout hole 63 and a multistage ejector structure 64, forming therebetween a first vacuum generating chamber **71*a* which is in communication with a vacuum chamber 74 through a suction passage 72*a* and defining vacuum generating chambers 71*b* and 71*c* around the circumference of the multistage ejector structure 64. Further, the end cover 58 is internally provided with silencers 93 and 94, and the suction cover 59 is provided with a suction filter 83 within the suction chamber 74**.

A major difference of this second embodiment from the first embodiment resides in the provision of an air feeder valve 65 which supplies compressed air to the jet hole 63 of the nozzle body 62, and a vacuum breaker valve 66 which supplies compressed air to the vacuum chamber 74 within the suction cover 59. These valves 65 and 66 are attached to the front cover 57 through a valve plate 67. A vacuum switch 87 is mounted on a lower deck portion **59*a* of the suction cover 59. The vacuum breaker valve 66 serves to supply pressurized air to a suction pad which is connected to a suction port 81** through a tube, thereby permitting to release a workpiece quickly from the suction pad.

Figure 6:
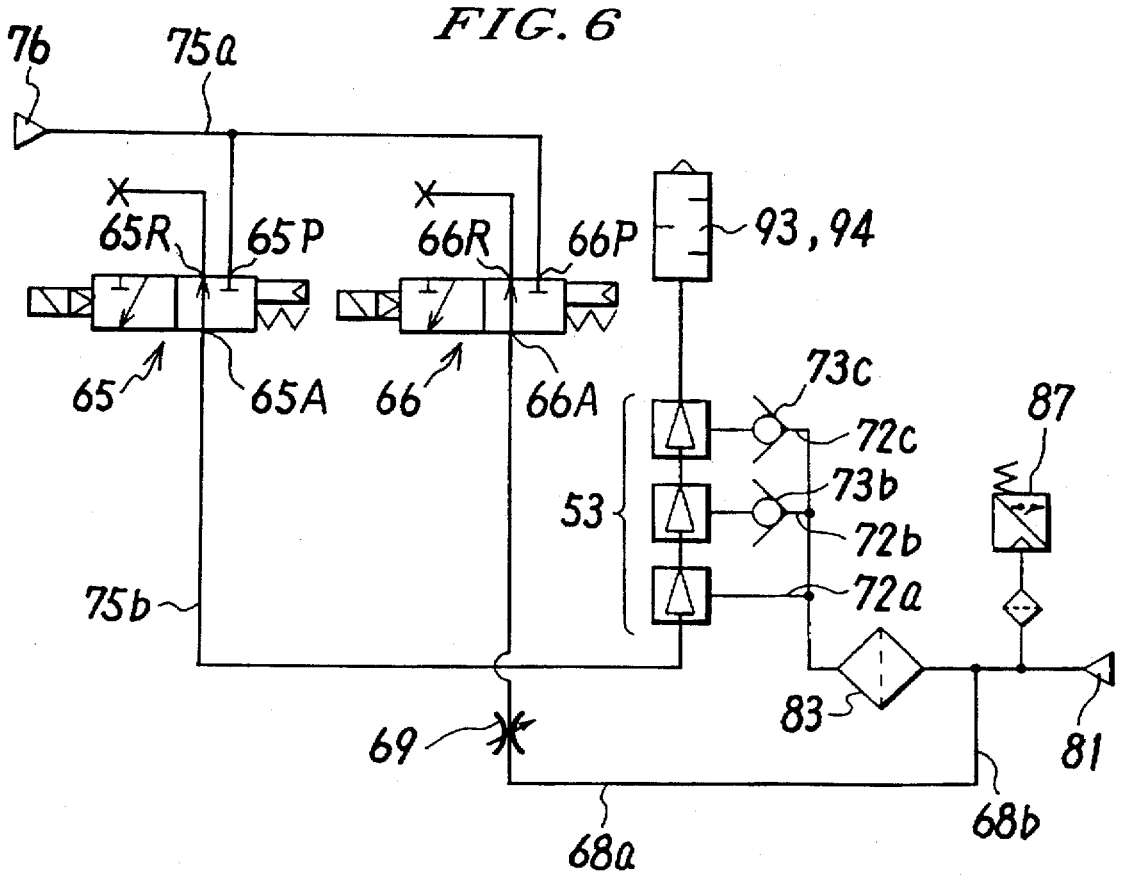
FIG. 6 schematically shows the layout of major components in the second embodiment by means of symbolic marks.

As indicated by symbolic marks in FIG. 6, the above-described air feeder valve 65 and vacuum breaker valve 66 are in the form of three-port electromagnetic valves of known arrangements, energizing or de-energizing a solenoid device to switch output ports 65A and 66A either to inlet ports 65P and 66P or to exhaust ports 65R and 66R, respectively. However, since the exhaust ports 65R and 66R are closed in this case, these two valves can be regard as two-port electromagnetic valves which operate to bring the respective inlet and outlet ports into and out of communication with each other. Needless to say, these valves 65 and 66 are not limited to electromagnetic valves and, for example, may be constituted by a valve which is operated by a pilot air pressure or the like or a mechanically driven valve.

In FIGS. 4 and 5, the inlet port of the above-described air feeder valve 65 is communicated with the air supply port 76 in the front cover 57 through a supply passage **75*a* which is formed in the valve plate 67 and the front cover 57, while its output port is communicated with the spout hole 63 of the nozzle body 62 through a supply passage 75*b*. Further, the vacuum breaker valve 66 has its inlet port communicated with the air supply port 76 through the supply passage 75*a* which is used commonly with the air feeder valve 65, and has its output port communicated with the vacuum chamber 74 within the suction cover 59 through a vacuum breaker passage 68a formed in the valve plate 67 and the front cover 57 and through a vacuum breaker passage 68*b* formed in the casing body 52. A flow regulator valve 69 is provided in the valve plate 67 for the purpose of adjusting the air flow rate through the vacuum breaker passage 68*a*. The flow regulator valve 69 includes a valve body 69*b* which is arranged to adjust the gap width of the flow passage upon turning a manual operating member 69*a***.

On the other hand, the vacuum switch 87, which is mounted on the lower deck **59*a* of the suction cover 59, is provided for detecting the level of the vacuum pressure which is introduced into the vacuum chamber 74 through a passage 85 opening on the top side of the lower deck 59*a*, and arranged to admit the vacuum pressure thereinto through a pressure inlet which is projected on the lower side of the deck 59*a*, detecting the vacuum pressure level by an internally installed semiconductor pressure sensor and digitally displaying the detected vacuum pressure level on an indicator portion 87*a* on its surface. The vacuum switch 87** is further provided with lead wires to supply output signals of the sensor to the outside (cf. Japanese Laid-Open Patent Application H3-86492).

Similarly to the vacuum block base 37 described hereinbefore in connection with the first embodiment, the vacuum switch 87 is mounted in position on the lower deck **59*a* by engaging projections 88 on the lower side of the switch with mounting holes 86 on the upper side of the lower deck 59*a*. The above-mentioned lead wires 87*b* are drawn out to the outside through an aperture in a cap 89*a* fitted on a wiring hole 89 in the end cover 58**.

A two-way valve which is operatively interlinked with the vacuum switch 87 may be provided between the suction port 81 and the suction pad which is connected to the suction port 81, thereby to maintain the vacuum pressure during the suction transfer of a work in a more reliable manner as compared with the check valves **73*b* and 73*c* which are associated with the suction passages 72*b* and 72*c***.

In the schematic illustration of FIG. 6 using symbolic marks, the respective constituent elements are designated by the same reference numerals as the corresponding parts in the description of FIGS. 4 and 5.

In case of the multistage ejector assembly 51 of the second embodiment which is arranged in the above-described manner, compressed air is supplied from the output port 65A of the air feeder valve 65 to the nozzle body 62 of the multistage ejector 53 to generate vacuum pressure at the suction port 81 in the same manner as in the foregoing first embodiment. This vacuum pressure is broken up upon closing the air feeder valve 65 and supplying vacuum breaker air to the vacuum chamber 74 from the breaker valve 66. The flow rate of this vacuum breaker air can be adjusted by way of the flow regulator valve 69. Besides, the vacuum level in the vacuum chamber 74 can be detected by the vacuum switch 87 to provide a basis for various controls.

In other respects, the operation of this embodiment is same as that of the first embodiment and therefore its description is omitted to avoid repetitions.

What is claimed is:

1. A multistage ejector assembly of the type including a casing body and a multistage ejector assembly into said casing body to produce a suction force of vacuum pressure at a suction port by the action of pressurized air supplied to said multistage ejector, wherein said multistage ejector assembly comprises:

said casing body being channel-shape in cross-section having a bottom wall internally providing an axial through hole to receive said multistage ejector structure, said casing body having a channel-like groove formed therein by a pair of parallel side walls extending from said bottom wall, said multistage ejector including a nozzle body connected to a supply of pressurized air and having a spout hole jetting pressurized air therefrom, and a multistage ejector structure which is separated from the nozzle body and which includes an ejector body which is molded a one piece integral structure comprising a plurality of diffuser-nozzles including a diffuser of a final stage, said diffuser nozzles being located in an axially aligned relation with said spout hole of said nozzle body and being connected through a diameter portion having a suction opening, wherein said ejector body has flanges respectively formed around said diffuser-nozzles and said diffuser of the final stage and wherein said ejector structure includes three seal members located between said ejector body and said casing;

said nozzle body and said multistage ejector being hermetically sealed in said axial through hole on said casing body to define therein a plurality of vacuum generating chambers by said flanges, said vacuum generating chambers being communicated with said groove through a plurality of suction passages provided on said casing body, and a vacuum chamber provided with said groove of said casing body between said suction port and said suction passes from said vacuum generating chambers.

2. A multistage ejector assembly as defined in claim 1, further comprising check valves anchored in position between the inner periphery of said axial through hole of said casing body and said flanges of said multistage ejector structure to block air flows to said suction passages from said vacumm generating chambers.

3. A multistage ejector assembly as defined in any one of claims 1 or 2, further comprising an air feeder valve supplying compressed air to said nozzle body, and a vacuum breaker valve supplying compressed air to said vacuum chamber.

* * * * *

UNITED STATES PATENT AND TRADEMARK OFFICE

CERTIFICATE OF CORRECTION

PATENT NO. : 5,683,227

DATED : November 4, 1997

INVENTOR(S) : Shigekazu NAGAI, et al.

It is certified that error appears in the above-identified patent and that said Letters Patent is hereby corrected as shown below:

On the title page, item [22], the PCT filing date should be:

--Feb. 24, 1994--

Signed and Sealed this

Twenty-seventh Day of January, 1998

*Attest:*

Bruce Lehman

BRUCE LEHMAN

*Attesting Officer*

*Commissioner of Patents and Trademarks*